US007416475B2

(12) United States Patent
Blaut et al.

(10) Patent No.: US 7,416,475 B2
(45) Date of Patent: Aug. 26, 2008

(54) METHOD FOR ROUGH-HONING THE PERIPHERAL SURFACE OF A BORE

(75) Inventors: Arnold Blaut, Neuhausen (DE); Gerhard Flores, Ostfildern (DE)

(73) Assignee: Gehring GmbH & Co. KG, Ostfildern (DE)

( * ) Notice: Subject to any disclaimer, the term of this patent is extended or adjusted under 35 U.S.C. 154(b) by 0 days.

(21) Appl. No.: 10/576,150

(22) PCT Filed: Aug. 6, 2004

(86) PCT No.: PCT/EP2004/008808

§ 371 (c)(1),
(2), (4) Date: Apr. 13, 2006

(87) PCT Pub. No.: WO2005/046934

PCT Pub. Date: May 26, 2005

(65) Prior Publication Data

US 2007/0054605 A1 Mar. 8, 2007

(30) Foreign Application Priority Data

Oct. 14, 2003 (DE) ..... 103 48 419

(51) Int. Cl.
*B24B 33/02* (2006.01)

(52) U.S. Cl. ..... 451/11; 451/51; 451/61

(58) Field of Classification Search ..... 451/11, 451/5, 8, 9, 10, 51, 57, 58, 27, 61

See application file for complete search history.

(56) References Cited

U.S. PATENT DOCUMENTS

| | | | | |
|---|---|---|---|---|
| 3,698,229 | A * | 10/1972 | Baksay | 72/341 |
| 4,254,591 | A | 3/1981 | Sedgwick et al. | 51/355 |
| 5,331,775 | A * | 7/1994 | Carmichael et al. | 451/51 |
| 6,554,549 | B1 | 4/2003 | Kurz | 408/1 |
| 7,189,143 | B2 | 3/2007 | Klein | 451/11 |

FOREIGN PATENT DOCUMENTS

| | | | |
|---|---|---|---|
| DE | 94 18 490 | 5/1996 | 3/6 |

OTHER PUBLICATIONS

U. Weigmann, "Pleuelstangen honen statt Feinbohren," Werkstatt und Betreib, May 2001, pp. 36-38.
Haasis et al. "Praxis des Langhubhonens", VDI, 1997.
Gerhard Haasis, "Zietgemäβe Vorrichtungsausführungen beim Langhub-und Dornhonen", Braunschweig, Nov. 1991.

* cited by examiner

*Primary Examiner*—Robert Rose
(74) *Attorney, Agent, or Firm*—O'Shea, Getz & Kosakowski, P.C.

(57) ABSTRACT

The invention relates to a method for rough-honing the peripheral surface (3) of a bore (2). According to said method, a honing tool (5) is introduced into the bore (2), the longitudinal axis ($M_B$) of the bore (2) before rough-honing comprising an off-set (s) relative to the finished bore (2). Said off-set (s) is evened out during rough-honing.

5 Claims, 2 Drawing Sheets

METHOD FOR ROUGH-HONING THE PERIPHERAL SURFACE OF A BORE

PRIORITY INFORMATION

This application claims priority from International application PCT/EP2004/008808, filed Aug. 6, 2004 and German application 103 48 419.1, filed Oct. 14, 2003.

BACKGROUND OF THE INVENTION

The invention relates to a method of rough-honing the circumferential surface of a bore.

Based on the possible metal-removing capacities and tool lives, it has already been proposed that fine-boring be replaced by rough-honing. In this way, the advantages of the honing process can be more fully utilized. In order, however, to achieve quality corrections in terms of angularity and positional precision comparable to those when using fine-spindle-machining, it is not possible to transfer the normal degrees of freedom for a honing tool and workpiece to rough-honing.

The concept of employing rough-honing instead of fine boring thus provides for a fixed alignment of the tool axis as well as fixed clamping of the workpiece. Based on the index position, the workpiece can be received with sufficient accuracy relative to the tool axis. Based on top and bottom tool guidance, a rigid alignment of the tool at the specified position of the bore can be achieved, with the result that the angular axial position of the tool is stable. The difference in regard to position and angular position of the tool axis to the pre-machined bore axis represents the required correction potential.

At the start of the rough-honing process, the honing stones only partially work the circumferential surface of the bore. As more and more material is removed, cutting expands to the full area of the entire bore. Since generally a varying amount of material is removed locally, a new bore center is created which is identical to the tool center. During the initial cut, only a few honing stones transfer the contact pressure to the bore wall. This therefore requires a form-locking feed device, i.e., an incremental feed. The feed functions consist in the intermittent feed motion, composed of the parameter defined from the feed phase and the feed pause interval in which the previously developed feed pressure diminishes.

This method of rough-honing, which is known from the article by U. Klink/G. Flores "Honing CGI Cylinder Bores" [*Honen von Zylinderbohrungen aus GGV*] in the journal *WB. Werkstatt und Betrieb*, Volume 133, 2000, Issue 4, Carl Hanser Verlag, Munich, can be implemented only with those workpieces in which very specific requirements are met in regard to accessibility of the bores, with the result that significant limits are placed on the method's scope of application. It is usable for continuous bores but not for blind-hole bores, which are predominantly encountered in, for example, cylinder barrels.

Therefore, there is a need for a technique of rough-honing the circumferential surface of a bore that has broader applicability.

SUMMARY OF THE INVENTION

This invention enables even those bores accessible only from one side to be machined in workpieces by rough-honing. At the same time, both correction of the bore position relative to a index bore and correction of the angular position of the bore axis are possible. This latter aspect is of considerable importance, in particular, in regard to engine blocks since angular precision relative to the crankshaft axis is critical.

Machining by honing begins first as a partial cut in which the tool is not yet in complete contact. Only when the entire surface of the bore has been machined and the honing stones contact both sides has the full cut been achieved.

A preferred further development of the method provides that the reciprocating motion of the honing tool be effected by a slide unit, at least during the machining of the section of the bore facing away from the slide unit, such that the working spindle is moved by the slide unit alternately in terms of its longitudinal axis. Independently of its instantaneous position, the slide unit provides a uniform guide stability for the spindle. Here the honing spindle is located at its top end position. The employed combination of the slide unit with the mounted honing spindle provides high stability for the slide unit in the partial cut, as well as high stroke speeds in the full cut, as enabled by a honing spindle. Based on this design, an overhung-mounted working spindle can be minimized in regard to its overall length. What is meant by minimal overall length here is that upon reaching the tool's lower travel reversal point along with the maximum conventional overrun length, the tool support is located just in front of the upper bore edge. This corresponds to the minimum overall length, below which value this dimension cannot fall, and by which the bore length to be honed is specified.

An initially effected partial cut of an electromechanical feed of the honing stones may be implemented with defined pause intervals. The switch from partial cut to the full cut parameter can be triggered by monitoring the power input since the torque increases with the full-area application of the cutting tools. This can also be a signal to retire the slide movement such that as a result the reciprocating motion is initiated by the honing spindle, and the alternating longitudinal motion by the honing spindle is effected in the full cut. The use of the slide unit as the stroke-drive enables the stability of the spindle to be significantly increased.

During full-cut honing, an electromechanical incremental feed is effected while the feed force acting on the honing stones is monitored. The result is a combination of displacement-controlled and force-controlled feed. In another further development of the method, a first honing stone set is impinged upon during the partial cut, while the full cut is implemented with a second honing stone set.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
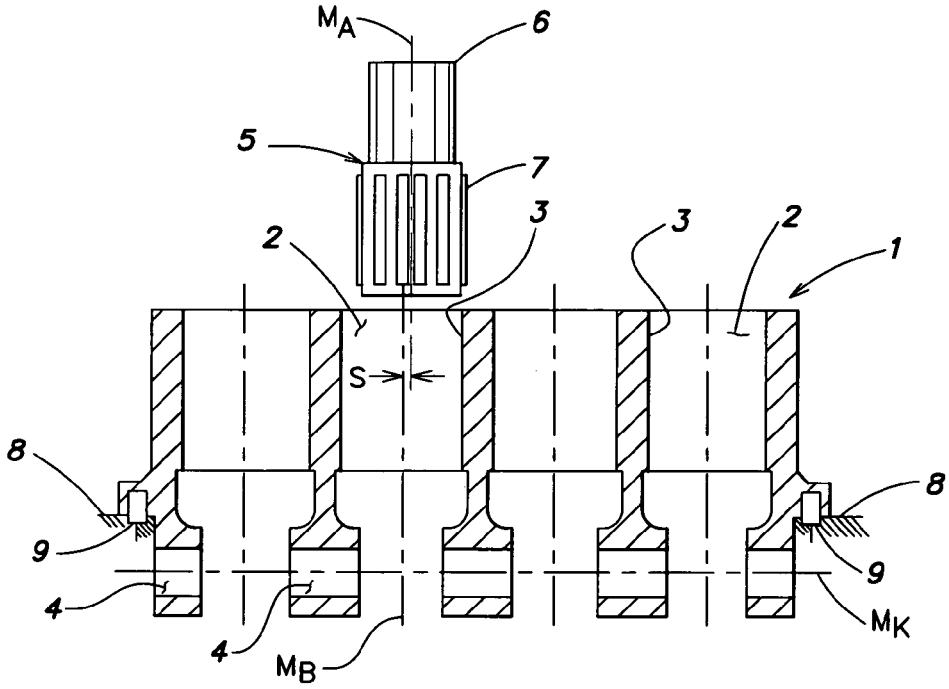
FIG. 1 shows a section through an engine block and a honing tool, illustrated schematically, located above the block.

FIG. 1 shows a workpiece 1, which in this embodiment is an engine block. This workpiece has multiple bores 2 which are provided in the form of cylinder bores and have a circumferential surface 3 which is to be machined. Each bore 2 has a longitudinal axis $M_B$. Multiple crankshaft bearings 4 are provided in the lower section of the engine block 1, the bearings having a common axis $_K$, i.e., the longitudinal axis of the crankshaft $M_K$. The engine block 1 is accommodated in a precise manner on the workpiece carrier 8 by indexing pins 9 so that the relative location of the workpiece 1 is precisely positioned.

In addition, the correction of the angular position of the bore axis entails an angularly correct accommodation of the workpiece. It is therefore necessary that axes $M_A$ and $M_K$ can be oriented at right angles to each other.

Shown above the workpiece 1 is a honing tool 5 which is located on an overhung-mounted working spindle 6 and comprises multiple honing stones 7 which are provided to machine the circumferential surface 3 of the bores 2. The working spindle 6, and thus the honing tool 5 itself, has a longitudinal axis $M_A$, wherein FIG. 1 reveals that before machining by the honing tool 5 an offset S occurs between longitudinal axis of the working spindle $M_A$ and the longitudinal axis of the bore $M_B$. Apart from a few exceptions, this offset of the axes is present which measures up to 0.3 mm.

As a result of the rough-honing operation, it is possible to implement an appropriate removal of material while simultaneously eliminating the offset S, thereby displacing the longitudinal axis of the bore $M_B$ to the extent that this axis corresponds exactly to the position actually required in the engine block 1, thereby approaching the longitudinal axis $M_A$. The result is that at the same time a high angular precision is achieved for the longitudinal axis of $M_B$ of the bore 2 relative to the longitudinal axis of crankshaft $M_K$.

To the extent the offset S of the longitudinal axis of the working spindle $M_A$ relative to the longitudinal axis of the bore $M_B$ is of a magnitude by which the free insertion of the honing tool 5 into the bore 2 is prevented, the longitudinal axis of the working spindle $M_A$ is deflected at a corresponding angle in order thereby to enter the bore 2 and machine the bore's circumferential surface 3. During machining, not only is the offset S of the longitudinal axes $M_A$ and $M_B$ relative to each other eliminated but so is any angle assumed by the longitudinal axis $M_A$ that might also be caused by the production tolerances of the engine block 1.

Figure 2:
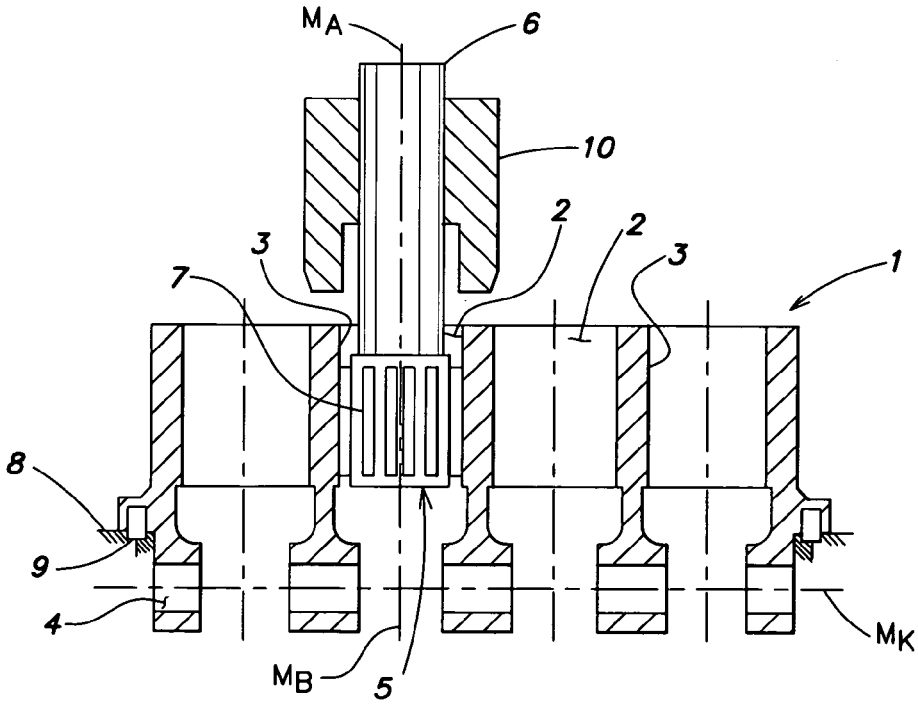
FIG. 2 shows a section through the engine block of FIG. 1 with the honing tool close to the end of the machining operation.

FIG. 2 shows a section through the engine block 1 of FIG. 1, wherein, however, the honing tool 5 is located in the bore 2 and the situation is illustrated near the end of machining. In regard to identical parts, the reference notations are the same as those of FIG. 1. It is evident in FIG. 2 that the working spindle 6 has been passed through a slide unit 10, wherein the slide unit 10 can be locked for a certain segment of the process (for example, working in the partial cut) with the working spindle 6 in the longitudinal axis of the working spindle 6 or of the longitudinal axis $M_A$. As illustrated in FIG. 2, the rough-honing operation has already progressed to the point that the longitudinal axis of the working spindle $M_A$ is coaxial with the longitudinal axis of the bore $M_B$ such that a uniformly honed circumferential surface is generated. In this first operating phase, it is advantageous to lock the working spindle 6 longitudinally within the slide unit 10 and to have the reciprocating motion effected by the slide unit 10 since this approach keeps the free end of the working spindle 6 projecting from the slide unit 10 as short as possible, thereby achieving a high level of flexural rigidity in the working spindle 6. Accordingly, during the first phase of the process, the working spindle 6 remains at its upper end position within the slide unit 10, thereby providing stabilization against lateral cutting forces. This aspect also achieves higher guiding precision and higher normal force stability.

Only during the full cut does the slide unit 10 remain in a fixed position, while the working spindle 6 effects a reciprocating motion relative to the slide unit 10 which is at rest. At the same time, it is possible to operate at higher stroke speeds so that rough-honing in the full cut is possible within short machining times.

Figure 3:
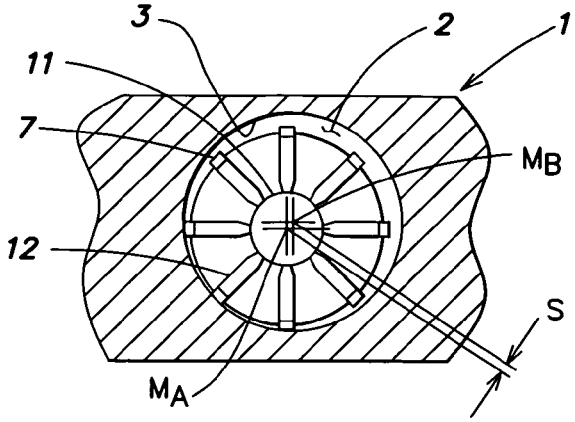
FIG. 3 shows a radial section through a bore and the honing tool at the start of machining.

FIG. 3 shows a radial section through the bore 2 and the honing tool 5 at the start of machining. It is evident here that the longitudinal axis $M_B$ of the bore 2 has a displacement or an offset S relative to the longitudinal axis $M_A$ of the working spindle, or of the honing tool 5. A feed rod 11 is centrically located within the honing tool 5, which rod acts through feed keys 12 on the honing stones 7. The feed keys 12 can be pressed outward by the feed rod 11, thereby also causing the honing stones 7 to effect a radially outward-directed motion.

As FIG. 3 shows, at the start of machining only a part of the honing tool 5 is applied to the circumferential surface 3 of the bore 2 such that in terms of the rough-honing operation initially only a partial cut is effected in which the honing tool 5 is not fully in contact. The removal of material only from a section of the circumferential surface 3 results in the bore center, and thus the longitudinal axis of the bore $M_B$, being displaced such that the longitudinal axis of the working spindle $M_A$ and the longitudinal axis of the bore $M_B$ approach each other. Only when the bore 2 is being machined everywhere with complete coverage, thus eliminating the offset S between the axes, is the bore 2 machined everywhere with complete coverage such that the honing stones 7 contact the entire circumference of the bore 2. As a result, the full cut is achieved by which the uniformly honed circumferential surface 3 is then generated.

Figure 4:
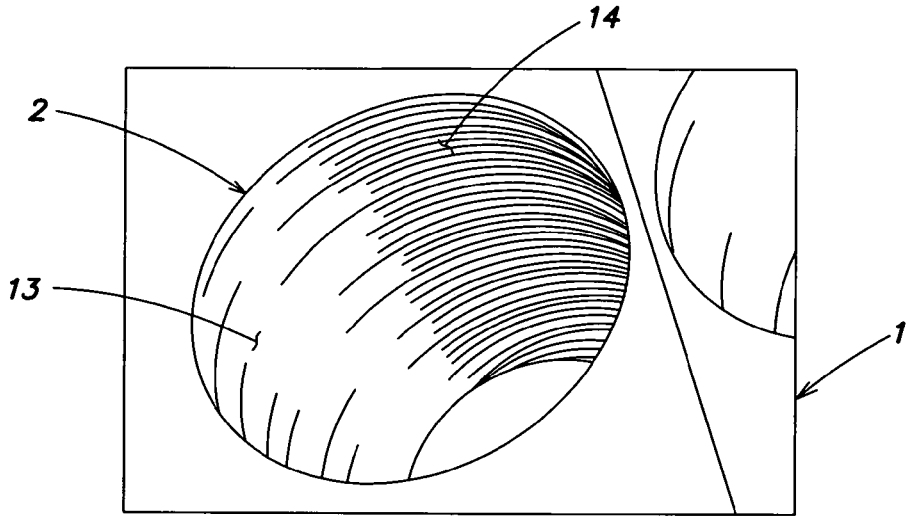
FIG. 4 is a perspective view of a section of a bore wall with the transition from turning profile to honing profile.

FIG. 4 is a perspective view of a section of the bore wall, or of the circumferential surface 3 of the cylinder bore 2. Here a section 13 with a turning profile in the left region of the bore 2 can be seen, while a section 14 with a honing profile in the right region of the bore 2 is present. This illustration clearly reveals that in the initially effected partial cut only a certain section of the circumferential surface 3 is machined by rough-honing and that there is a transition from the turning profile to the honing profile.

Figure 5:
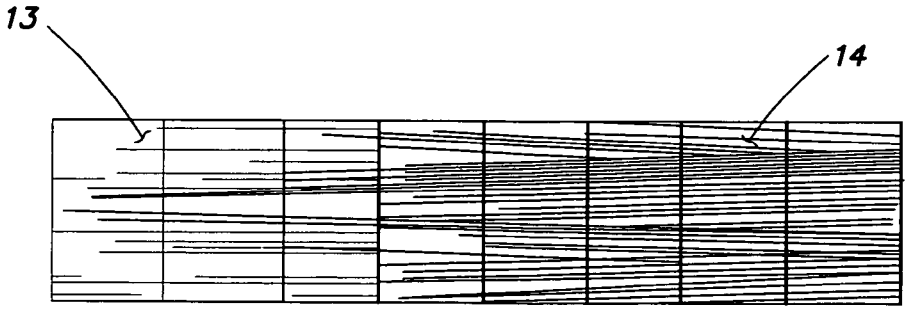
FIG. 5 is a developed view of a section of the bore wall of FIG. 4.

FIG. 5 is a developed view of a section of the bore wall in FIG. 4 which also clearly reveals the transition from the turning profile to the honing profile.

Although the present invention has been illustrated and described with respect to several preferred embodiments thereof, various changes, omissions and additions to the form and detail thereof, may be made therein, without departing from the spirit and scope of the invention.

What is claimed is:

1. A method of machining the circumferential surface of a bore by rough-honing using a honing tool received by an overhung-mounted working spindle and provided with honing stones, said working spindle having a longitudinal axis ($M_A$) and said honing stones being feedable in radially outward direction, in which, at the start of the machining process, the honing tool is inserted eccentrically into the bore such that the longitudinal axis ($M_B$) of the bore has a certain offset (S) from the axis ($M_A$) of the working spindle and the honing stones only partially work along the circumferential surface of the bore in a partial cut, and, when the honing stones are pressed in said radially outward direction during the machining process, the longitudinal axis of the bore ($M_B$) approaches the longitudinal axis of the working spindle ($M_A$) until the circumferential surface of the bore is machined with complete coverage everywhere in a full cut eliminating the offset (S) and any angle between the axes ($M_A$, $M_B$), and subsequently the circumferential surface is uniformly honed with said full cut.

2. The method of claim 1, where at least during the machining of a section of the circumferential surface of the bore facing away from a slide unit a reciprocating motion of the honing tool is effected by the slide unit such that the working spindle is moved by the slide unit alternately in terms of its longitudinal axis ($M_A$).

3. The method of claim 2, where during rough-honing in the partial cut a form-locking incremental feed of the honing stones is effected with defined pause intervals.

4. The method of claim 1, where during the rough-honing in the full cut a frictionally engaged incremental feed is effected, wherein the feed force acting on the honing stones is monitored.

5. The method of claim 4, where during rough-honing in the partial cut a first set of honing stones is impinged upon, and the rough-honing in the full cut is implemented with a second set of honing stones.

* * * * *